US009921039B2

(12) United States Patent
Billings

(10) Patent No.: US 9,921,039 B2
(45) **Date of Patent: *Mar. 20, 2018**

(54) HIGH VELOCITY IGNITION SYSTEM FOR AMMUNITION

(71) Applicant: Vista Outdoor Operations LLC, Clearfield, UT (US)

(72) Inventor: Chris Billings, Layton, UT (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/175,885

(22) Filed: Jun. 7, 2016

(65) Prior Publication Data

US 2017/0067724 A1 Mar. 9, 2017

Related U.S. Application Data

(63) Continuation of application No. 14/216,130, filed on Mar. 17, 2014, now Pat. No. 9,360,223.
(Continued)

(51) Int. Cl.
*F42B 5/00* (2006.01)
*F42B 7/04* (2006.01)
(Continued)

(52) U.S. Cl.
CPC ..... *F42B 7/04* (2013.01); *F42B 5/16* (2013.01); *F42B 7/02* (2013.01)

(58) Field of Classification Search
CPC .. F42B 5/045; F42B 5/105; F42B 5/38; F42B 7/00; F42B 7/02; F42B 7/08; F42C 19/0826
(Continued)

(56) References Cited

U.S. PATENT DOCUMENTS 389,496 A 9/1888 Brown
390,232 A 10/1888 Hurst
(Continued)

FOREIGN PATENT DOCUMENTS

CA 2173968 4/1995
FR 78417 7/1962

OTHER PUBLICATIONS

Carlson et al., "Combination Gas Operated Rifle and Subsonic Cartridge" U.S. Appl. No. 14/216,386, filed Mar. 17, 2014, 153 pgs.

*Primary Examiner* — Bret Hayes
(74) *Attorney, Agent, or Firm* — Christensen, Fonder, Dardi & Herbert PLLC

(57) ABSTRACT

A high velocity ignition system for ammunition including an casing, a primer, a payload, a first propellant region, a flash tube, a second propellant and at least one channel. The casing has a base portion and a forward portion. The primer is provided in the base portion. The payload is provided proximate the forward portion. The first propellant region is located in the casing intermediate the primer and the payload. The flash tube substantially extends between the primer and the first propellant region. The second propellant region is located in the casing intermediate the first propellant region and the base portion. The at least one channel extends between the first propellant region and the second propellant region. A separator with a forward extending cup and a rearward extending cup has a cylindrical portion that engages the inside surface of the casing, spans the internal distance in the casing, and defines flash pathways between the primer and main propellant and between the main propellant and the secondary propellant.

19 Claims, 2 Drawing Sheets

Related U.S. Application Data

(60) Provisional application No. 61/801,812, filed on Mar. 15, 2013.

(51) Int. Cl.
*F42B 5/16* (2006.01)
*F42B 7/02* (2006.01)

(58) Field of Classification Search
USPC ..... 102/433, 434, 443
See application file for complete search history.

(56) References Cited

U.S. PATENT DOCUMENTS 504,736 A 9/1893 Maxim
1,812,010 A 6/1931 McBride
3,134,330 A 5/1964 Batou
3,176,617 A 4/1965 Brafford
3,712,225 A 1/1973 Nimylowycz
3,738,272 A 6/1973 Grosbard
4,197,801 A 4/1980 LaFever et al.
4,335,657 A 6/1982 Bains
4,593,622 A 1/1986 Fibranz
4,604,954 A 8/1986 Clarke et al.
4,674,405 A 6/1987 Brede et al.
4,823,699 A 4/1989 Farinacci
4,938,145 A 7/1990 Martwick
5,016,536 A 5/1991 Brighton
5,029,530 A 7/1991 Martwick et al.
5,048,422 A 9/1991 Northrup et al.
5,048,423 A 9/1991 Garrett
5,062,366 A 11/1991 Candland et al.
5,067,408 A 11/1991 Martwick
5,192,829 A 3/1993 Suire
5,355,764 A 10/1994 Marinos et al.
5,359,937 A 11/1994 Dittrich
5,429,030 A 7/1995 Tidman
5,492,063 A 2/1996 Dittrich
5,677,505 A 10/1997 Dittrich
5,880,397 A 3/1999 Crilly
6,158,348 A 12/2000 Campoli
6,178,889 B1 1/2001 Dindl
6,415,718 B1 7/2002 Saxby
6,439,123 B1 8/2002 Dionne et al.
6,564,719 B2 5/2003 Saxby
6,625,916 B1 9/2003 Dionne
6,931,978 B1 8/2005 Dionne
7,207,276 B1 4/2007 Dindl
7,225,741 B2 6/2007 Huffman
7,278,358 B2 10/2007 Huffman
7,500,433 B1 3/2009 Forrester
7,621,208 B2 11/2009 Huffman
7,984,668 B2 7/2011 Huffman
8,146,505 B2 4/2012 Huffman
8,220,393 B2 7/2012 Schluckebier et al.
9,360,223 B1 * 6/2016 Billings ..... F42B 5/16
2002/0195017 A1 * 12/2002 Priimak ..... F42C 19/0826 102/470
2010/0101444 A1 4/2010 Schluckebier et al.
2010/0236395 A1 9/2010 Akhavan
2010/0269724 A1 10/2010 Head et al.
2011/0252999 A1 10/2011 Carlson et al.
2014/0196625 A1 7/2014 Huffman et al.

* cited by examiner

HIGH VELOCITY IGNITION SYSTEM FOR AMMUNITION

CROSS-REFERENCE TO RELATED APPLICATIONS

The present application is a continuation of U.S. patent application Ser. No. 14/216,130, filed Mar. 17, 2014, now U.S. Pat. No. 9,360,223, which claims the benefit of U.S. Provisional Patent Application No. 61/801,812 filed Mar. 15, 2013, both of which are hereby incorporated by reference herein in their entireties.

FIELD OF THE INVENTION

The invention is directed to ammunition. More particularly, the invention is directed to a high velocity ignition system for ammunition.

BACKGROUND OF THE INVENTION

There are various references directed to the concept of increasing the performance of ammunition such as bullets and shotgun shells. The contents of each of the references discussed herein are incorporated by reference for all purposes.

Fibranz, U.S. Pat. No. 4,593,622, describes an industrial cartridge having two propellant sections. A flash tube has a thinner end wall than side wall. As a result of this configuration, the flame passes through the end of the flash tube to ignite the first propellant section. The second propellant charge is adjacent to the first propellant section such that ignition of the first propellant section results in ignition of the second propellant section.

Crilly, U.S. Pat. No. 5,880,397, is directed to ammunition having two propellant regions. A first propellant region contains low velocity propellant and is located between the primer and the projectile. A second propellant region contains high velocity propellant is located around an outer surface of the primer.

Dindl, U.S. Pat. No. 7,207,276, discloses non-lethal ammunition having a two-stage firing. The ammunition includes an inner propellant region and an outer propellant region that extends around the inner propellant region. The outer and inner propellant regions are ignited using separate primers.

Schluckebier et al., U.S. Pat. No. 8,220,393, is directed to ammunition having two propellant regions. A first propellant region is located along a central axis of the ammunition between the primer and the payload. The second propellant region is located radially outward from the first propellant region such that the second propellant region is between the first propellant region and an casing of the ammunition.

Thouin, French Patent No. 78,417, describes ammunition having a first propellant region that is located along a central axis of the ammunition between the primer and the payload. Similar to Schluckebier, which is discussed above, a second propellant region is located radially outward from the first propellant region such that the second propellant region is between the first propellant region and an casing of the ammunition.

Chetcuti, Canadian Patent Publication No. 2,173,968, discloses ammunition that is configured to reduce recoil typically associate with shotgun ammunition. The ammunition includes a plurality of toric members mounted to an outer surface of the flash tube. Each of the toric members has an air space therein, which enables the toric members to deflect and thereby absorb the recoil

SUMMARY OF THE INVENTION

An embodiment of the invention is direct to a high velocity ignition system for ammunition that includes an casing, a primer, a payload, a first propellant region, a flash tube, a second propellant region and at least one channel. A propellant separator The casing has a base portion and a forward portion. The primer is provided in the base portion. The payload is provided proximate the forward portion. The first propellant region is located in the casing intermediate the primer and the payload.

The flash tube substantially extends between the primer and the first propellant region. The flash tube may have an extension to extend upwardly near the forward portion of the propellant facilitating a rearward burn. The second propellant region is located in the casing intermediate the first propellant region and the base portion. The at least one channel extends between the first propellant region and the second propellant region.

Another embodiment of the invention is directed to a method increasing velocity of ammunition. A primer is activated to cause a first flame to be emitted therefrom. The first flame is directed through a flash tube towards a first propellant region. The first propellant region is ignited with the first flame.

A second flame is directed from the first propellant region to the second propellant region through at least one channel. The second propellant region is in a spaced-apart configuration from the first propellant region. The second propellant region is ignited with the second flame. The payload is propelled away from the casing with a combined force generated by the ignition of the first propellant region and the second propellant region.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to ammunition that exhibits enhanced payload velocity when compared to prior art ammunition. The ammunition is identified at 10 in the figures.

The prior art ammunition generates a payload velocity that is limited by a maximum pressure rating for the gun system in which the ammunition is intended to be used. The ammunition produced according to this invention is able to achieve a payload velocity that is greater than the prior art by using two propellant chambers, which are ignited in sequence as is discussed in more detail below.

Figure 1:
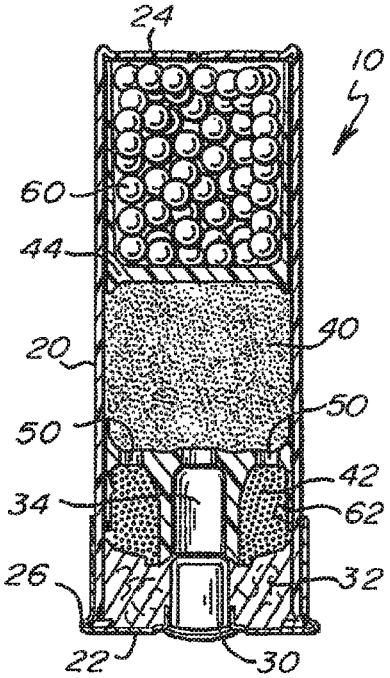
FIG. 1 is a side view of ammunition that incorporates a high velocity ignition system according to an embodiment of the invention prior to ignition.

The ammunition 10 includes an casing 20, as illustrated in FIG. 1. In certain in embodiments, the casing 20 has a generally cylindrical shape and includes a base portion 22 and a forward load exit portion 24.

The casing 20 is formed with a size, a shape and from a material based upon a type of gun system (not shown) in which the ammunition 10 is intended to be used. In certain embodiments, the ammunition 10 is designed for in small caliber gun systems. In other embodiments, the ammunition 10 is designed for use in a shotgun or a rifle. A principal embodiment is utilized for 12 gauge and 20 gauge shotgun shells.

In certain configurations, the base portion or head 22 includes an outwardly extending flange 26 that facilitates retaining the ammunition 10 in a desired position within the gun system during the firing process. A person of skill in the art will appreciate that the outwardly extending flange 26 may have a variety of shapes and sizes depending on the gun system in which the ammunition 10 is intended to be used. The illustrated flange is suitable for shotgun shell applications.

The casing 20 may have a generally tubular configuration in which the other components of the ammunition 10 are placed. A primer 30 may be placed in the base portion 22. along a central axis of the ammunition 10. A propellant separator and flashtube unit 23 provides a flash tube 34 to directly transfer the flash of the primer to the forward propellant, further flash path ways 50, which may be channels or tubes in certain embodiments, extend from the rearward region of the forward propellant chamber to the rearward propellant chamber. Positioned around the primer 30 in the base portion 22 may be a spacer configures as a basewad 32 assemble with the cartridge, or the spacer may be an integral or unitary part of the head of the cartridge. In certain embodiments, the basewad or spacer 32 may have a height that is similar to or equal to a height of the primer 30. An edge of the basewad 32 that is opposite the base portion 22 may be cupped so that proximate the casing 20, the basewad 32 has a greater height than proximate the primer 30. Using such a configuration may cause a force generated by the ignition of the propellant in the first propellant region 40 and the second propellant region 42 to be directed towards the payload 60 to thereby increase a velocity as which the payload 60 is propelled from the gun system.

The ammunition 10 includes at least two propellant regions 40, 42, forward chamber and a rearward chamber, that are separated from each other to facilitate sequentially, that is, staged, igniting the propellant regions. The first propellant region 40 may contain the primary propellant that is used to initially launch and propel the payload 60. As such, a volume of the first propellant region 40 may be greater than a volume of the second propellant region 42.

The first propellant region 40 may be located proximate to a lower end of the payload 60 such that the first propellant region 40 and the payload 60 are on opposite sides of a payload cup that may function as a gas obturating wad 44.

A volume of the first propellant region 40 may be selected based upon a variety of factors. Examples of these factors include the type of gun system in which the ammunition 10 is intended to be used, the maximum pressure intended to be generated, and the weight and type of payload.

In particular embodiments, there is a distance between the first propellant region 40 and the primer 30. A flash tube 34 may be provided between the primer 30 and the first propellant region 40. The flash tube 34 directs a flame that is emitted when the primer 30 is ignited towards the first propellant region 40.

Figure 5:
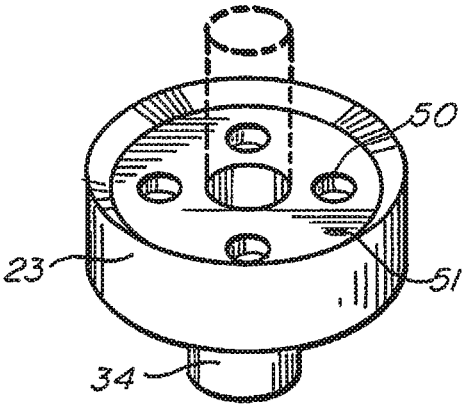
FIG. 5 is a perspective view of the propellant separator, integral flash tube and wadding.
Figure 6:
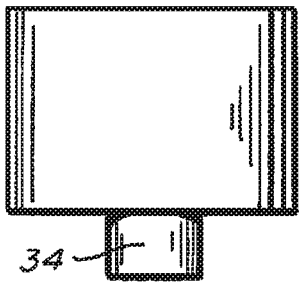
FIG. 6 is a side elevational view of the propellant separator and integral flash tube of FIG. 5.
Figure 7:
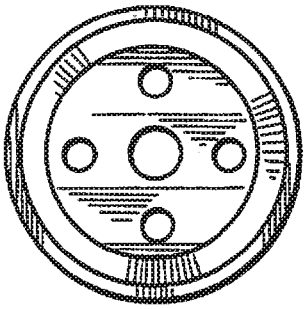
FIG. 7 is a top plan view of the propellant separator and integral flash tube of FIG. 5.
Figure 8:
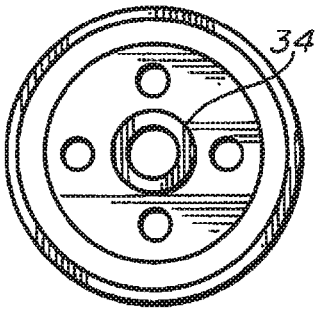
FIG. 8 is a bottom plan view of the propellant separator and integral flash tube of FIG. 5.

The flash tube 34 thereby prevents the second propellant region 42 from igniting when the first propellant region 40 is ignited. A person of skill in the art will appreciate that a variety of configurations and materials may be used for fabricating the propellant separator and flash tube 34. As indicated in FIG. 5, the flash tube can have an extending portion extend toward the forward portion of the main propellant region facilitating a rearward burn and likely delaying the ignition of the secondary propellant.

In certain embodiments, the flash tube 34 has a substantially tubular profile with a diameter that is generally consistent between the primer 30 and the first propellant region 40. In other embodiments, the flash tube 34 tapers so that a diameter of the flash tube 34 proximate the primer 30 is greater than a diameter of the flash tube 34 proximate the first propellant region 40. The flash tube is advantageously integral with the structure providing the propellant separation and flash pathways between the main forward propellant and the rearward secondary propellant.

The second propellant region 42 may be formed in a donut-shape that extends around at least a portion of the flash tube 34. By forming the second propellant region 42 to extend around the flash tube 34 enhances the ability to apply an even force to the payload 60 to thereby cause the payload 60 to be propelled in a linear direction.

In certain embodiments, the second propellant bed 42 substantially fills a region between the first propellant region 40 and the basewad 32 that is outside of the primer 30. In other embodiments, at least one filler material such as a wad 62 may be provided in this region when it is desired for a smaller volume of the second propellant region 42 to be used.

A height of the second propellant region 42 is less than the height of the flash tube 34. Using such a configuration, there is a separation of the first propellant region 40 and the second propellant region 42.

At least one flash tube channel 50, defined by structure 51 of the propellant separator and flashtube unit 23, substantially extends between the first propellant region 40 and the second propellant region 42. The at least one channel 50 thereby directs flame emitted from the first propellant bed 40 to the second propellant bed 42 to cause efficient and reproducible ignition of the second propellant bed 42.

The at least one channel 50 may thereby be used to control a delay between ignition of the first propellant region 40 and the second propellant region 42 by varying a number and/or a size of the at least one channel 50. The channels could also be configured as tubes.

For example, when the at least one channel 50 is formed with a greater area and/or there are a greater number of the at least one channel 50, the delay between ignition of the first propellant region 40 and the second propellant region 42 may be decreased. Conversely, decreasing the area of the at least one channel 50 and/or the number of the at least one channel 50 may increase the delay between ignition of the first propellant region 40 and the second propellant region 42.

In certain embodiments there are a plurality of generally cylindrically shaped channels 50 that substantially extend between the first propellant region 40 and the second propellant region 42. Each of these channels may have a diameter that is less than a thickness of each side of the second propellant region 42, as illustrated in the figures.

In another embodiments, the at least one channel 50 has a cylindrical shape with an inner diameter that is larger than an inner diameter of the second propellant region 42 and an outer diameter that is smaller than an outer diameter of the second propellant region 42. Using such a configuration, the at least one channel 50 limits the ability of the flames emitted from the first propellant region 40 to reach the second propellant region 42.

The delay between ignition of first propellant region 40 and the second propellant region 42 may be selected to flatten a pressure time curve generated by the ammunition 10. A factor that may affect the desired delay include the maximum pressure of the gun system. For example, if the delay is too short, the combined pressure exerted by the first propellant region 40 and the second propellant region 42 may exceed the maximum pressure of the gun system.

In certain embodiments, the propellant in the first propellant region 40 may be the same as the propellant in the second propellant region 42. In other embodiments, the propellant in the first propellant region 40 may be formed from a different material than the propellant in the second propellant region 42. For example, the propellants may be selected to have different combustion rates. An example of one suitable propellant that may be used in the first propellant region 40 and the second propellant region 42 is gun powder.

A payload 60 is provided proximate the forward portion 24. The payload 60 is the portion of the ammunition 10 that is propelled when the first propellant region 40 and the second propellant region 42 are ignited. The payload 60 may assume a variety of forms depending on the type of gun system in which the ammunition is intended to be used.

An example of one type of payload 60 is a plurality of shot pellets 62 that are loosely placed within the forward portion 24 when the ammunition is a shotgun shell. Another example of the payload 60 is a slug that is attached to the forward portion 24 when the ammunition is a bullet.

Figure 2:
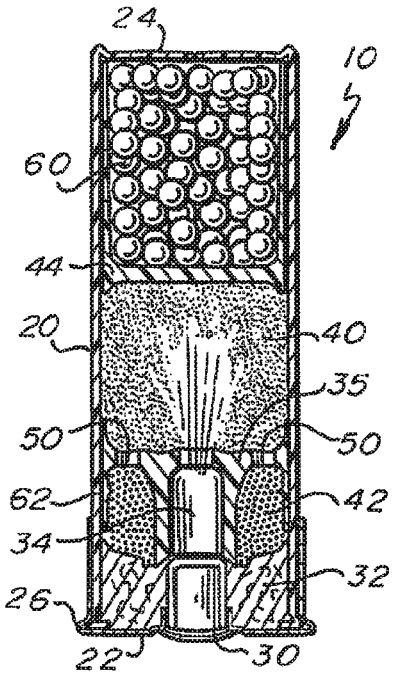
FIG. 2 is a side view of the ammunition where propellant in a first propellant region has been ignited.

In operation, the primer 30 is ignited as illustrated in FIG. 2. This ignition causes a flame to be emitted from the primer 30. This flame passes through the flash tube 32 and into the first propellant region 40 to cause the first propellant region 40 to be ignited.

Figure 3:
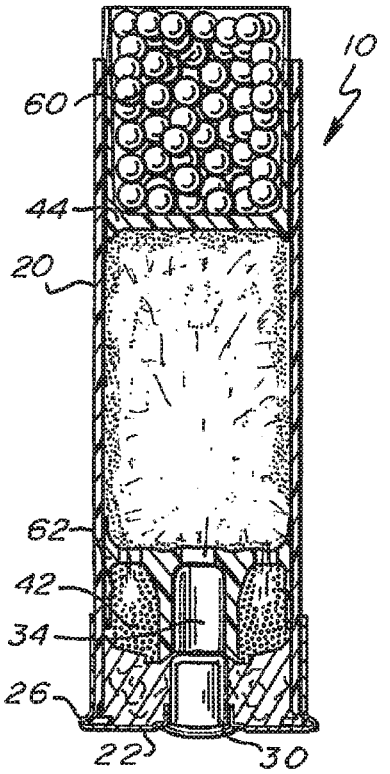
FIG. 3 is a side view of the ammunition where the propellant in the first propellant region causes a payload to be pushed out of the ammunition and causes propellant in a second propellant region to be ignited.
Figure 4:
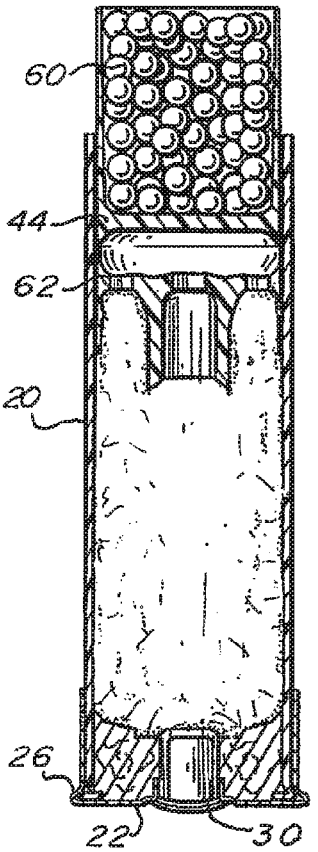
FIG. 4 is a side view of the ammunition where the ignited propellant in the first propellant region and the second propellant region causes the payload to be pushed out of the ammunition.

Ignition of the first propellant region 40 causes the payload 60 to be forced out of the casing 20, as illustrated in FIG. 3. Ignition of the first propellant region 40 also causes flames to pass through the at least one channel 50.

The flames passing through the at least one channel 50 then cause the second propellant region 42 to ignite. This process causes the wading and the payload 60 to be accelerated forward out of the gun system.

As noted above, the configuration of the ammunition 10 causes a delay between the ignition of the first propellant region 40 and the second propellant region 42. This delay in ignition increases the pressure behind the payload 60 without the combined pressure from the first propellant region 40 and the second propellant region exceeding the maximum pressure of the gun system. This process thereby increases the velocity of the payload 60 as the payload exits the gun system.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A shotgun shell comprising:

a shotgun shell casing having a base portion and a forward portion configured for a shotgun;

a primer provided in the base portion;

a payload being one of a plurality of shotgun shell shot pellets and a shotgun shell slug provided in the forward portion;

separation structure provided rearward of the payload, the separation structure defining a first propellant region located in the casing intermediate the primer and the payload; and a second propellant region located in the casing intermediate the first propellant region and the base portion;

the separation structure having:

a flash tube substantially extending between the primer and the first propellant region;

a divider separating the first propellant region from the second propellant region, at least one channel extending between the first propellant region and the second propellant region;

the shotgun shell further comprising propellant in the first propellant region and propellant in the second propellant region.

2. The shotgun shell of claim 1, wherein the second propellant region extends at least partially around the flash tube.

3. The shotgun shell of claim 1, wherein the second propellant region has a height that is less than a height of the flash tube.

4. The shotgun shell of claim 1, wherein the first propellant region and the second propellant region are in a spaced-apart relationship.

5. The shotgun shell of claim 1, and further comprising a separator with an integral flash tube for confronting the primer and defining a plurality of flash path ways between the first propellant region and the second propellant region, wherein the separator provides an upwardly facing cup portion and a downwardly facing cup portion.

6. The shotgun shell of claim 1, wherein propellant in the first propellant region is different than propellant in the second propellant region.

7. A method of increasing velocity of ammunition without increasing a maximum pressure rating for a gun system in which the ammunition is used, the method comprising:

activating a primer to cause a first flame to be emitted therefrom;

directing the first flame through a flash tube towards a first propellant region and past a second propellant region, the second propellant region position laterally of the flashtube and rearward of the first propellant region;

igniting the first propellant region with the first flame;

directing a second flame from the first propellant region to the second propellant region through at least one channel, wherein the second propellant region is in a spaced-apart configuration from the first propellant region;

igniting the second propellant region with the second flame; and propelling the payload away from the casing with a combined force generated by the ignition of the first propellant region and the second propellant region.

8. The method of claim 7, wherein the payload is propelled away from the casing at a rate that is greater than a rate at which igniting the first propellant region would propel the payload from the casing.

9. The method of claim 7, wherein sequential igniting of the first propellant region and the second propellant region flattens a pressure time curve compared to a pressure time curve generated only by ignition of the first propellant region.

10. The method of claim 7, wherein a total pressure generated by sequential igniting of the first propellant region and the second propellant region is less than a total pressure generated by simultaneous ignition of the first propellant region and the second propellant region.

11. The method of claim 7, wherein the flash tube substantially extends between the first propellant region and the second propellant region.

12. The method of claim 7, wherein there is a delay between igniting the first propellant region and igniting the second propellant region.

13. The method of claim 12, wherein upon firing the payload has left the casing when the secondary propellant is ignited.

14. The method of claim 7, wherein the second propellant region extends at least partially around the flash tube.

15. The method of claim 7, wherein the second propellant region has a height that is less than a height of the flash tube.

16. The method of claim 7, and further comprising placing wading between the first propellant region and the second propellant region, wherein the wading extends around the at least one channel.

17. The method of claim 7, wherein propellant in the first propellant region is different than propellant in the second propellant region.

18. The method of claim 7, wherein the payload comprises a plurality of shot, a slug or combination thereof.

19. The method of claim 7, and further comprising mounting the primer, the flash tube, the first propellant region, the second propellant region, and the at least one channel in an casing.

* * * * *